US010576535B2

(12) United States Patent
Niane et al.

(10) Patent No.: US 10,576,535 B2
(45) Date of Patent: Mar. 3, 2020

(54) MOLD FOR FABRICATING A MONOCRYSTALLINE BLADE BY CASTING, A FABRICATION INSTALLATION AND METHOD USING THE MOLD

(71) Applicants: SAFRAN, Paris (FR); SAFRAN AIRCRAFT ENGINES, Paris (FR)

(72) Inventors: Ngadia Taha Niane, Moissy-Cramayel (FR); Saïd Boukerma, Moissy-Cramayel (FR); Serge Dillenseger, Moissy-Cramayel (FR); Julien Gelebart, Moissy-Cramayel (FR); David Grange, Moissy-Cramayel (FR); Jean-Claude Marcel Auguste Hanny, Moissy-Cramayel (FR); Philippe Metron, Moissy-Cramayel (FR)

(73) Assignees: SAFRAN, Paris (FR); SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/305,326

(22) PCT Filed: Jun. 1, 2017

(86) PCT No.: PCT/FR2017/051371
§ 371 (c)(1),
(2) Date: Nov. 28, 2018

(87) PCT Pub. No.: WO2017/207933
PCT Pub. Date: Dec. 7, 2017

(65) Prior Publication Data

US 2019/0337048 A1 Nov. 7, 2019

(30) Foreign Application Priority Data

Jun. 2, 2016 (FR) ..... 1655021

(51) Int. Cl.
*B22C 9/22* (2006.01)
*B22C 9/04* (2006.01)
*B22D 27/04* (2006.01)

(52) U.S. Cl.
CPC ..... *B22C 9/22* (2013.01); *B22C 9/04* (2013.01); *B22D 27/045* (2013.01)

(58) Field of Classification Search
CPC .. B22C 9/04; B22C 9/22; B22D 27/04; B22D 27/045
(Continued)

(56) References Cited

U.S. PATENT DOCUMENTS 5,489,194 A 2/1996 Yoshinari et al.
7,918,265 B2 * 4/2011 Verner et al. ..... B22C 7/02 164/122.2

(Continued)

FOREIGN PATENT DOCUMENTS

DE 100 33 688 A1 1/2002
EP 2 092 996 A1 8/2009

(Continued)

OTHER PUBLICATIONS

International Search Report as issued in International Patent Application No. PCT/FR2017/051371, dated Sep. 27, 2017.
International Preliminary Report on Patentability and the Written Opinion of the International Searching Authority as issued in International Patent Application No. PCT/FR2017/051371, dated Dec. 4, 2018.

*Primary Examiner* — Kevin P Kerns
(74) *Attorney, Agent, or Firm* — Pillsbury Winthrop Shaw Pittman LLP

(57) ABSTRACT

A ceramic material mold for use in molding a turbine engine blade from a molten metal, the blade including a root, an inner platform, an airfoil, and an outer platform, and the mold including a cavity having the shape of the blade, and an auxiliary grain duct including a first segment and a second segment that is an extension of the first segment, the (Continued)

first segment opening out at one end into a first portion of the cavity forming the root of the blade, and at another end into a second portion of the cavity forming a lip of the inner platform of the blade, the second segment opening out at one end into the second portion of the cavity, and at another end into a third portion of the cavity forming a lip of the outer platform of the blade.

7 Claims, 5 Drawing Sheets

(58) Field of Classification Search
USPC ..... 164/122.1, 122.2, 338.1, 361
See application file for complete search history.

(56) References Cited

U.S. PATENT DOCUMENTS 8,307,882 B2 * 11/2012 Creasey ..... B22D 27/045
164/122.1
9,833,834 B2 * 12/2017 Congratel et al. ..... B22D 25/02

FOREIGN PATENT DOCUMENTS

EP 2 223 755 A1 9/2010
WO WO 2014/135782 A1 9/2014
WO WO 2014/195634 A1 12/2014

* cited by examiner

MOLD FOR FABRICATING A MONOCRYSTALLINE BLADE BY CASTING, A FABRICATION INSTALLATION AND METHOD USING THE MOLD

CROSS REFERENCE TO RELATED APPLICATIONS

This application is the U.S. National Stage of PCT/FR2017/051371 filed Jun. 1, 2017, which in turn claims priority to French Application No. 1655021, filed Jun. 2, 2016. The contents of both applications are incorporated herein by reference in their entirety.

BACKGROUND OF THE INVENTION

The present invention relates to the general field of methods of fabricating parts by casting. The invention relates more particularly to a mold for fabricating a monocrystalline turbine engine blade by lost wax casting.

In certain circumstances, and in particular in aviation turbine engines, it is necessary to have metal or metal alloy parts that present a controlled monocrystalline structure. For example, in turbine nozzles of aviation turbine engines, the blades need to withstand large thermomechanical stresses due to the high temperature and to the centrifugal forces to which they are subjected. A controlled monocrystalline structure in the metal alloys forming these blades enables the effects of such stresses to be limited.

In order to make a metal part of this type, lost wax type casting methods are known. In known manner, in such a method, a wax model is initially made of the part that is to be fabricated, and a ceramic shell is then formed around it to form a mold. Thereafter molten metal is cast into the mold and directional solidification of the metal makes it possible, after removing the mold, to obtain the molded part or "casting". This method is advantageous for fabricating metal parts of complex shapes, and it enables parts to be obtained that are of monocrystalline structure, e.g. by using a seed or a grain selector duct.

Blades generally comprise a root, an inner platform having lips, an airfoil, an outer platform having lips, and wipers. During the fabrication of monocrystalline blades by a method of the kind described above, certain problems appear, due in particular to the shape of the blades.

During the directional solidification of the molten metal present in the mold having the shape of the blade, those portions of the mold cavity that form in particular the lips of the inner and outer platforms solidify somewhat later than the other portions of the cavity such as those forming the airfoil. This delay can lead to undesirable pores appearing in the final part.

In addition, at the end of heat treatment that is performed after directional solidification, it has been observed that the blade may present interfering recrystallized grains at certain locations, and in particular on the leading edge or the trailing edge in the proximity of the inner or outer platforms. This is not desirable when it is desired to obtain a monocrystalline blade.

Finally, the blades that are obtained may present significant variation in dimensions between the wax model and the final part, and can sometimes be deformed or twisted.

There therefore exists a need to have a mold for fabricating a turbine engine blade and a method of fabricating such a blade that reduce the appearance of the above-mentioned defects.

OBJECT AND SUMMARY OF THE INVENTION

A main object of the present invention is thus to mitigate such drawbacks by proposing a ceramic material mold for use in molding a turbine engine blade from a molten metal, the blade comprising a root, an inner platform, an airfoil, and an outer platform, and the mold comprising:

- a cavity having the shape of the blade; and
- an auxiliary grain duct comprising a first segment and a second segment extending the first segment, said first segment opening out at one end into a first portion of the cavity forming the root of the blade, and at another end into a second portion of the cavity forming a lip of the inner platform of the blade, said second segment opening out at one end into said second portion of the cavity, and at another end into a third portion of the cavity forming a lip of the outer platform of the blade.

The presence of the auxiliary grain duct in the mold of the invention serves to minimize the defects described above. Firstly, the auxiliary grain duct serves to ensure that the inner and outer platforms of the blade do not solidify last, thereby reducing the appearance of pore type defects in those segments of the blade.

Thereafter, the auxiliary grain duct acts as a stay holding the blade and stiffening it throughout the fabrication method. By holding the blade in this way, the residual stresses that might remain therein are reduced, and the appearance of recrystallized grains after heat treatment is also diminished.

The inventors have observed that the blade obtained with a mold of the invention presents dimensions that are closer to the desired dimensions compared with a blade fabricated in a mold that does not have an auxiliary grain duct. The inventors have also observed that the resulting blade is less twisted when fabricated in a mold of the invention.

The auxiliary grain duct may be positioned facing the leading edge or the trailing edge of the blade.

The following characteristics relating to the auxiliary grain duct serve to further limit the thickness of the ceramic shell, thus making it easier to break and thereby reducing the appearance of recrystallized grains:

- the first segment of the auxiliary grain duct extends from a wall of the first portion of the cavity in a direction that forms an angle lying in the range 54° to 62° with said wall;
- the second segment of the auxiliary grain duct extends from the second portion of the cavity in a direction forming an angle lying in the range 110° to 115° with said second portion; and
- the second segment of the auxiliary grain duct extends from the third portion of the cavity in a direction forming an angle lying in the range 110° to 115° with said third portion.

In an embodiment, still for the purpose of limiting the thickness of the ceramic shell and of enabling it to break more easily so as to reduce the appearance of recrystallized grains, the second segment of the auxiliary grain duct may present at least one portion having a circular section of diameter D, said portion being spaced apart from the cavity by a distance L, the ratio R=L/D between the distance L and the diameter D lying in the range 16.4 to 18.9 along said portion.

In order to further reduce the appearance of pores in the inner and outer platforms, the second segment of the auxiliary grain duct may include a feeder at each of its ends. The first segment may have a feeder at one end.

The blade may be a turbine blade for an aviation turbine engine.

In order to facilitate unmolding of the blade, the second segment of the auxiliary grain duct may present a constriction, i.e. a local reduction in its section, e.g. in the middle of said second segment. Specifically, the auxiliary grain duct can break more easily at this constriction during unmolding.

The invention also provides an installation for fabricating a blade molded from a molten metal, the installation comprising a mold as described above, and monocrystalline grain obtaining means connected to the mold.

The monocrystalline grain obtaining means may comprise a monocrystalline seed or a grain selector duct.

Finally, the invention provides a method of fabricating a monocrystalline turbine engine blade, the method comprising the following steps:

filling a mold of an installation as described above with a molten metal; and directionally solidifying the metal present in the mold so as to obtain a molded blade.

The method may also include a step of applying heat treatment to the resulting blade. This heat treatment serves to relax residual stresses inside the molded blade, which may be due in particular to the molding and the solidification of the metal, so as to obtain a final part having a microstructure that is stable and mechanical properties that are controlled.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF THE INVENTION

Figure 1:
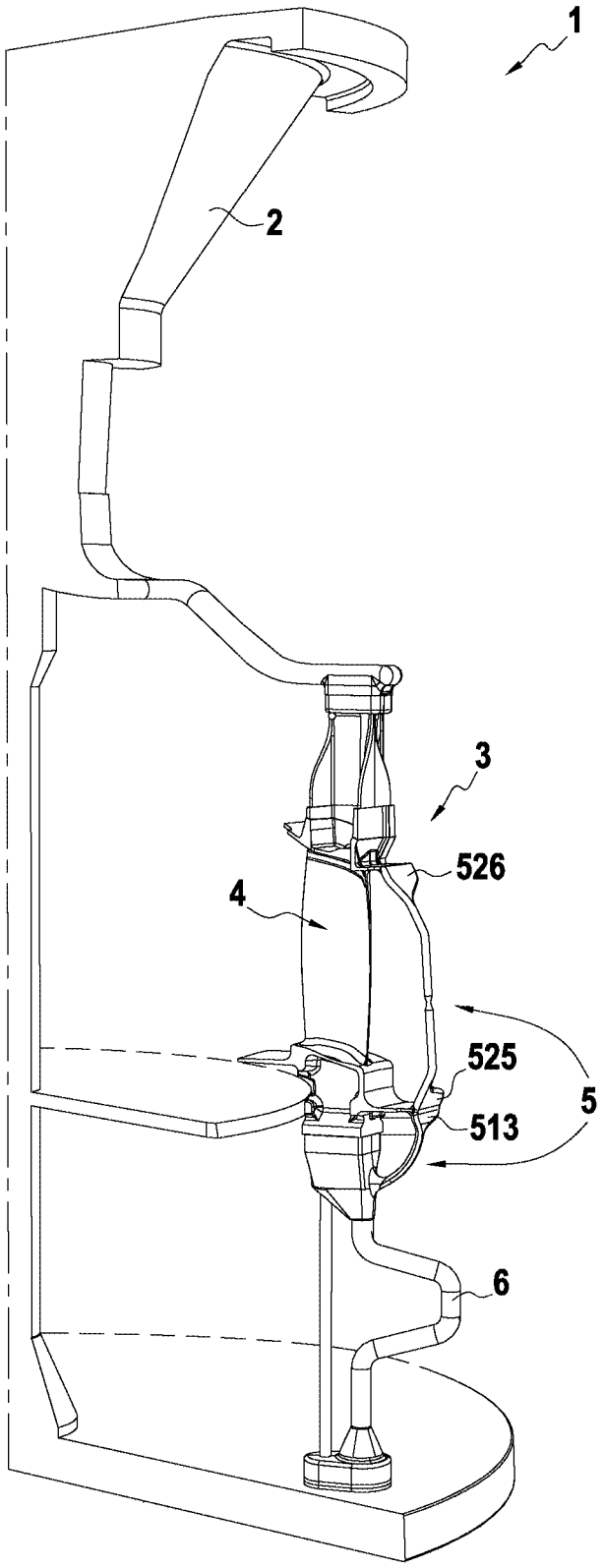
FIG. 1 is a perspective view of an installation of the invention.

FIG. 1 shows an installation 1 of the invention for fabricating a monocrystalline turbine blade for an aviation turbine engine by casting. The installation 1 comprises a bush 2 for pouring molten metal, the bush 2 being configured to fill a mold 3 with this metal, the mold in this example having a cavity 4 in the shape of a turbine blade for an aviation turbine engine. In accordance with the invention, the mold 3 includes an auxiliary grain duct 5. The mold 4 is located above and connected to a grain selector duct 6 that enables a monocrystalline blade to be obtained after directional solidification of the metal present in the mold 3. It should be observed that although the installation shown in FIG. 1 is designed to fabricate a single blade, it is naturally possible to envisage having an installation for fabricating a plurality of blades.

Figure 2:
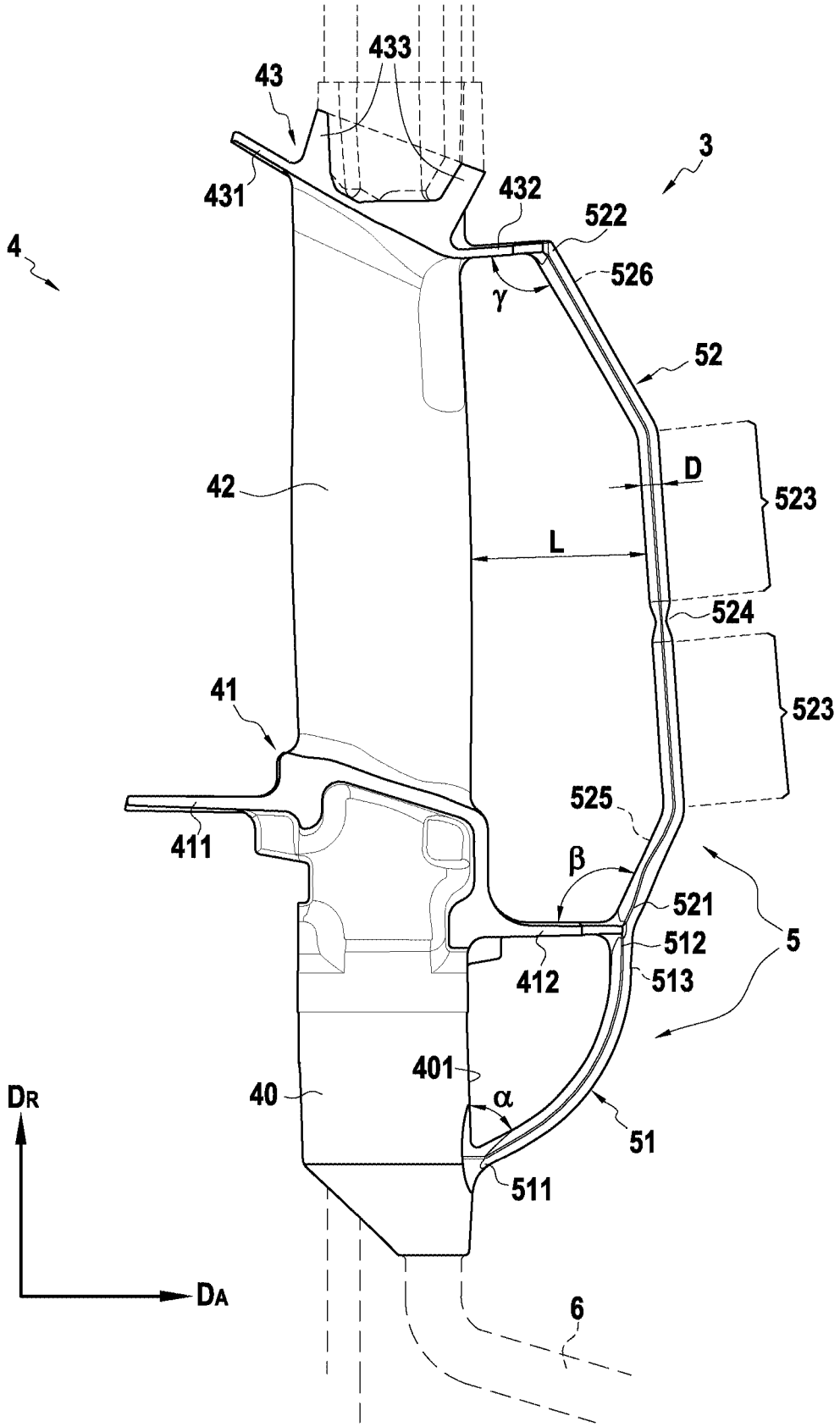
FIG. 2 is a section view of a mold in an embodiment of the invention.

FIG. 2 is a section view of the cavity 4 of the mold 3 to which the auxiliary grain duct 5 is connected. It should be observed that in FIGS. 1 and 2, to make them more readable, the ceramic material wall of the installation 1 and of the mold 3 is not shown; in other words, these figures show only the internal portions of the installation 1 or of the mold 3 into which molten metal can be inserted.

Throughout the description, the terms "bottom" and "top" are defined relative to the direction DR, the arrow of the direction DR pointing outwards. The terms "upstream" and "downstream" are defined relative to the direction DA, the arrow of the direction DA pointing downstream. In other words, upstream and downstream are defined relative to the flow direction of the gas stream around the blade when the blade is mounted in a turbine engine.

The cavity 4 has the shape of a turbine blade for an aviation turbine engine and comprises: a portion 40 forming the blade root; a portion 41 forming the inner platform of the blade; a portion 42 forming the airfoil of the blade; and a portion 43 forming the outer platform of the blade. The root-forming portion 40 is connected via its bottom to the grain selector duct 6. In known manner, the blade extends longitudinally between a root and a tip. In the molded blade, the inner platform is positioned beside the bottom end of the airfoil, between the root and the airfoil, and the outer platform is positioned at the top end of the airfoil, i.e. at the tip of the blade. The inner platform extends transversely between a downstream end, also referred to as the downstream lip, and an upstream end, also referred to as the upstream lip. The outer platform extends transversely between an upstream end, also referred to as the upstream lip, and a downstream end also referred to as the downstream lip. The inner and outer platforms serve in particular to define the flow passage for the gas stream through the turbine. The airfoil extends longitudinally between the inner and outer platforms, and transversely between a leading edge and a trailing edge.

The portion 41 of the cavity 4 forming the inner platform has a sub-portion 411 forming an upstream lip of the platform and a sub-portion 412 forming a downstream lip of the platform. The lip-forming sub-portions 411 and 412 are substantially planar in shape and they extend substantially along the direction DA.

The portion 43 of the cavity 4 forming the outer platform is provided with a sub-portion 431 forming an upstream lip of the platform (or a first end of the platform), and a sub-portion 432 forming a downstream lip of the platform (or a second end of the platform). The lip-forming sub-portions 431 and 432 are substantially planar. The sub-portion 432 forming the downstream lip of the outer platform extends downstream substantially along the direction DA, while the sub-portion 431 forming the upstream lip extends upstream and slopes relative to the direction DA. The portion 43 also has sub-portions 433 that extend generally in the direction DR in order to form the wipers of the blade. The cavity 4 is filled from its top portion via the portion 43, with the filling duct from the bush 2 of the installation 1 being drawn in dashed lines in FIG. 2.

In accordance with the invention, the mold 3 has an auxiliary grain duct 5 having a first segment 51 and a second segment 52 extending the first segment 51. The first and second segments 51 and 52 of the duct 5 are in fluid flow communication with each other. The first segment 51 opens out at a bottom end 511 into the root-forming portion 40 of the cavity 3, and at a top end 512 into the sub-portion 412 forming the downstream lip of the inner platform. The second segment 52 opens out at a bottom end 521 into the sub-portion 412, in this example at the same location as the first segment 51, and at a top end 522 in the sub-portion 432 forming the downstream lip of the outer platform.

At its bottom end 511, the first segment 51 of the duct 5 extends from a downstream wall 401 of the portion 40 of the cavity 4. In the example shown, the first segment 51 extends from the downstream wall 401 forming an angle $\alpha$ therewith of about 60°, this angle α may lie in the range 54° to 62°. The first segment 51 describes a curve or bend between the portion 40 and the sub-portion 412.

At its top end 521, the second segment 52 of the duct 5 extends from the sub-portion 412 forming the downstream lip of the inner platform. In the example shown, the second segment 52 extends from the sub-portion 412 forming an angle β therewith of about 115°, this angle β may lie in the range 110° to 115°. At its top end 522, the second segment 52 extends from the sub-portion 432 forming the downstream lip of the outer platform. In the example shown, the second segment 52 extends from the sub-portion 432 while forming an angle γ of about 115° therewith, this angle γ likewise may lie in the range 110° to 115°.

At least part of the second segment 52 may present a circular section of diameter D. In the example shown, the second segment 52 presents portions 523 that are spaced apart from the airfoil-forming portion 42 of the cavity 4 by a distance L. In this example, the portions 523 are both substantially rectilinear. The ratio R=L/D along these portions 523 may lie in the range 16.4 to 18.9.

In the example shown, a middle part of the second segment 52 present a constriction 524 corresponding to a local reduction in the diameter of the second segment 52. This constriction can serve subsequently to make it easier to break the second segment 52 of the duct 5 after directional solidification of the metal, so as to reduce the stresses that are imposed on the molded blade.

At its top end 512, the first segment 51 may present a feeder 513 that can be seen in FIG. 1. At its bottom and top ends 521 and 522, the second segment 52 may present two respective feeders 525 and 526 (FIG. 1).

The feeders correspond to enlargements of the segments 51 and 52 of the duct 5 level with the lips 412 and 432. As mentioned above, these feeders 513, 525, and 526 can serve to reduce the appearance of pores in the lips of the molded blade. Specifically, the feeders serve to improve the feed of liquid metal into the portions of the cavity 4 that form the lips of the blade, thereby modifying the cooling isothermals in these portions and reducing the formation of pores during solidification.

In the example shown, it should be observed that the duct 5 is positioned on the downstream side of the cavity (i.e. in particular it is connected to the sub-portions 412 and 432 that form the downstream lips), but that it is nevertheless possible to envisage positioning it on the upstream side with it being connected in particular to the sub-portions 411, 431 that form the upstream lips.

It should also be observed that the preferred characteristics relating to the angles α, β, and γ, and also to the distance L and the diameter D are all shown on a single mold 3, but they need not be applied simultaneously.

Figure 3:
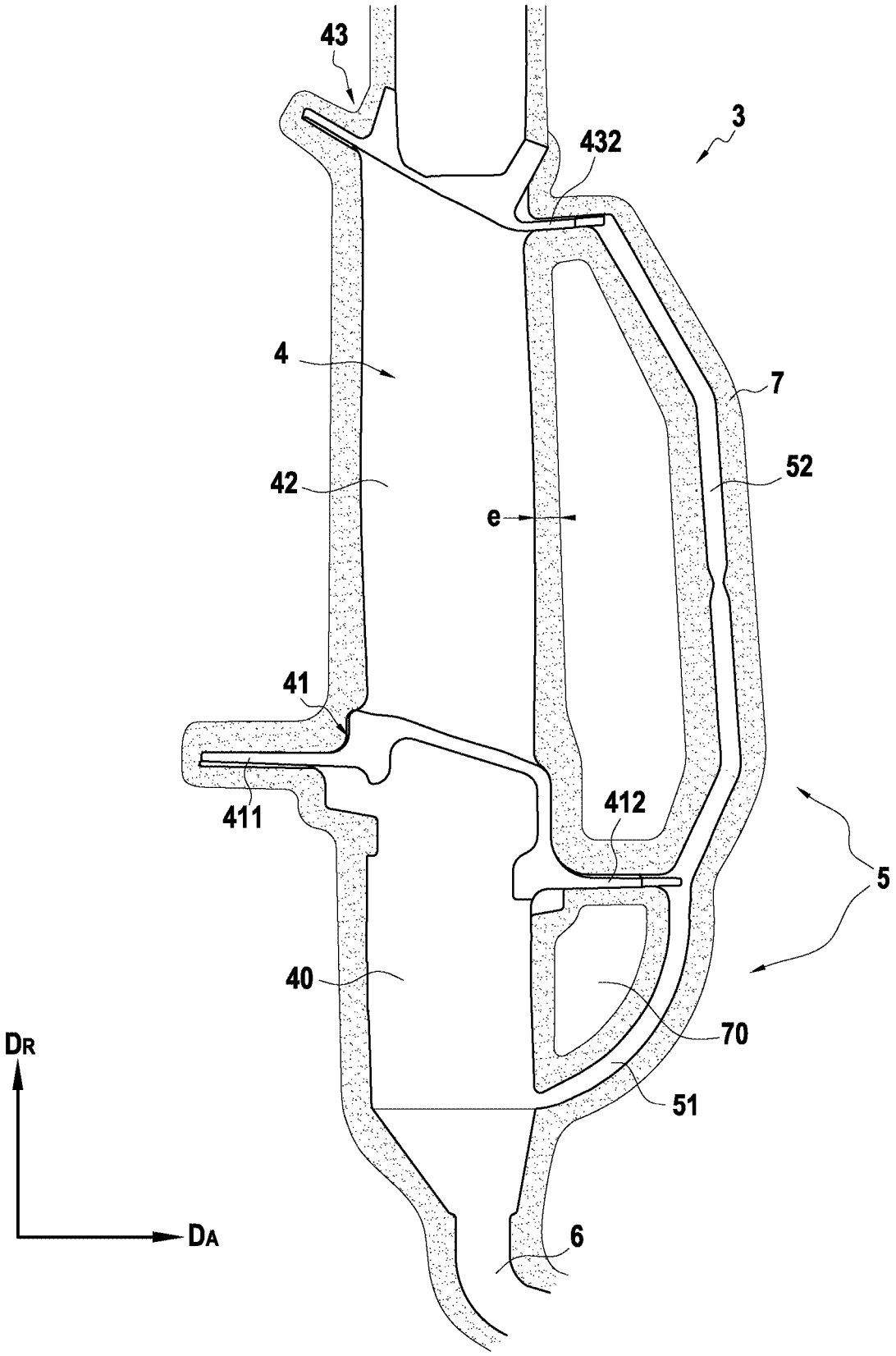
FIGS. 3 and 4 are section views of molds in different embodiments of the invention.
Figure 4:
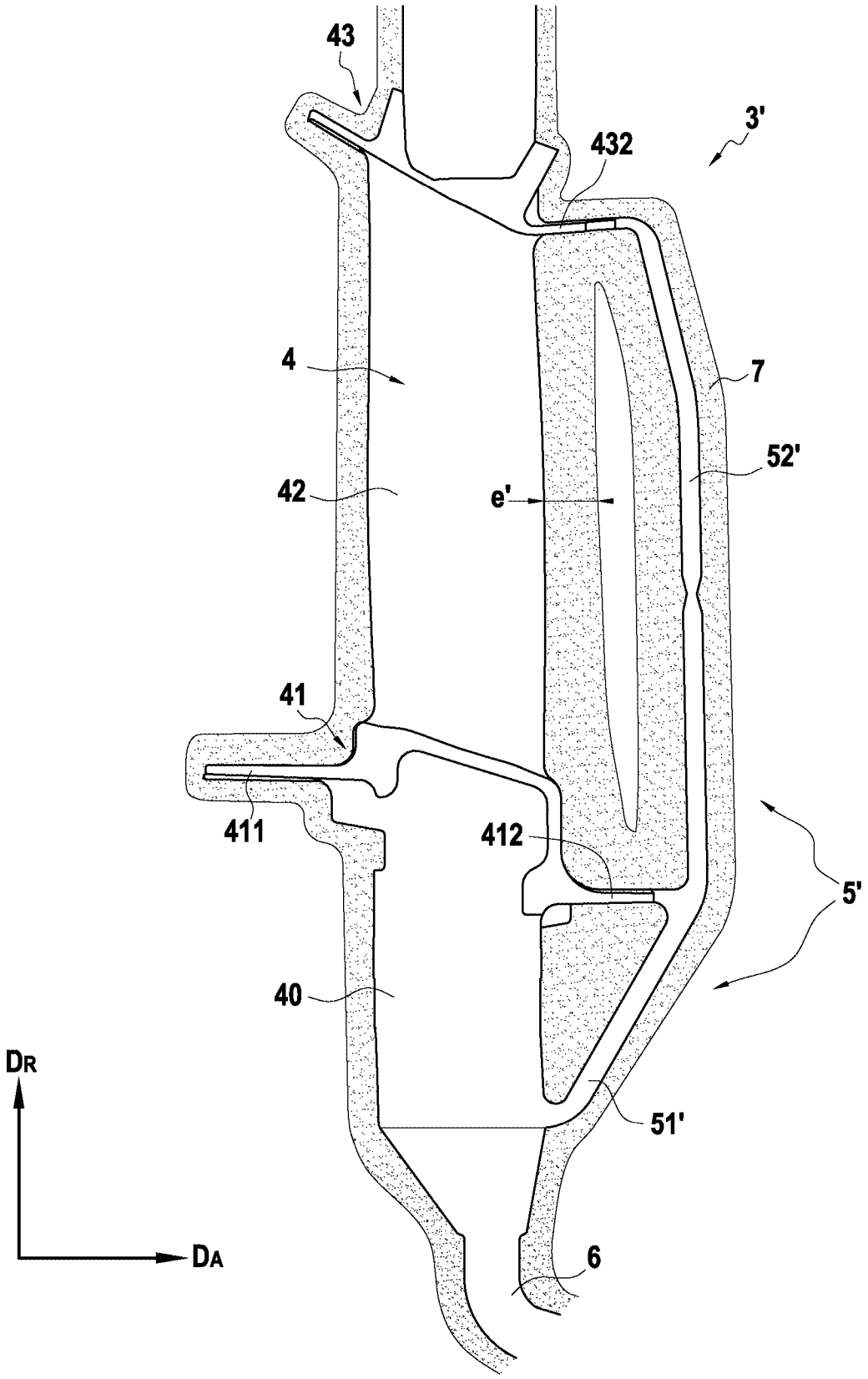

FIGS. 3 and 4 show respectively the mold 3 as described above and a mold 3' in another embodiment of the invention. In these figures, the molds 3 and 3' are shown with their ceramic shells 7. The ceramic shells of the molds 3 and 3' are made using the same operating techniques so that they can be compared.

The auxiliary grain duct 5' of the mold 3' presents a first segment 51' that is straight and that extends at an angle strictly less than 54° from the portion 40, this angle being about 45° in this example. The duct 5' presents a second segment 52' that extends the first segment 51' and that extends from the sub-portion 412 forming the downstream lip of the inner platform at an angle of about 90°.

It can be seen that the shape of the duct 5 of the mold 3 (FIG. 3) makes it possible to obtain a ceramic shell 7 presenting thickness e for the wall of the portion 42 situated facing the duct 5 that is less than the thickness e' obtained for the mold 3' (FIG. 4). This thickness difference is made possible by the shape of the above-described duct 5, which is optimized compared with the duct 5'. In addition, in the mold 3, it can be seen that the shape of the first segment 51 enables an empty space 70 to be obtained between the first segment 51 and the portion 40; whereas in the mold 3', the shape of the first segment 51' can lead to this space being filled in with ceramic so as to form a ceramic shell that is thicker. As explained above, reducing the thickness of the ceramic shell makes it possible to further reduce the stresses that are exerted on the molded blade, and thus reduce the potential appearance of recrystallized grains after heat treatment.

The above-described installation 1 may be made entirely out of ceramic material, e.g. by a lost wax casting method. In known manner, a wax model of the installation 1 needs to be fabricated initially. Thereafter, the wax model is covered in a ceramic shell by being dipped successively into an appropriate slurry (dipping/coating). The ceramic is subsequently fired and the wax removed in order to obtain the installation 1 made of ceramic material.

Figure 5:
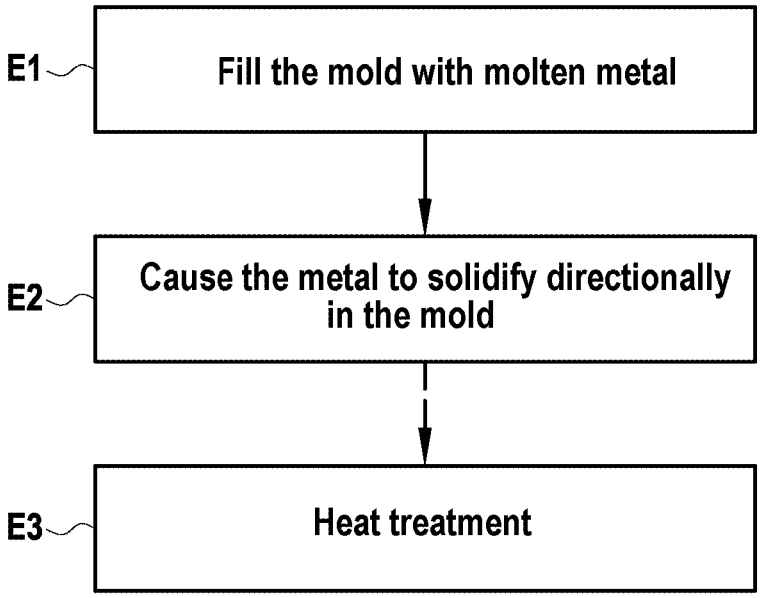
FIG. 5 is a flow chart showing the main steps of a method of fabricating a monocrystalline blade in an implementation of the invention.

FIG. 5 shows the main steps of a method of fabricating a molded part from molten metal by using an installation 1 as described above. The first step E1 of the method consists in filling the mold 3, 3' of the installation 1 by pouring molten metal into the installation. For this purpose, it is possible to pour the metal directly into the bush 2 of the installation 1, and the metal can flow under gravity so as to fill the mold 3, 3'.

The second step E2 consists in performing directional solidification of the metal present in the mold so as to obtain the molded blade. Directional solidification is performed in an appropriate furnace in which the installation is placed. The furnace serves to control the growth of crystal grains so as to obtain a monocrystalline blade as a result of the presence of a grain selector duct 6 or of a monocrystalline seed. The shell may already have begun to break by the end of directional solidification. Once the part has solidified, it can be knocked out. Thereafter, the portions connected to the blade and corresponding in particular to the auxiliary grain duct 5, 5' can be cut off.

Finally, it is possible to perform a last step E3 consisting in heat treatment that serves in particular to dissipate the residual stresses in the molded part. For a blade made of AM1 type superalloy, the heat treatment may for example consist in subjecting the blade to a temperature lying in the range 1270° C. to 1330° C. for a duration lying in the range 18 hours (h) to 23 h. By using a mold 3, 3' of the invention, it has been found that there is a reduction in the appearance of recrystallized grains following this step.

Throughout the description, the term "lying in the range . . . to . . . " should be understood as including the bounds.

The invention claimed is:

1. A ceramic material mold for use in molding a turbine engine blade from a molten metal, the blade comprising a root, an inner platform, an airfoil, and an outer platform, and the mold comprising:

a cavity having a shape of the blade; and an auxiliary grain duct comprising a first segment and a second segment being an extension of the first segment, said first segment opening out at one end into a first portion of the cavity forming the root of the blade, and at another end into a second portion of the cavity forming a lip of the inner platform of the blade, said second segment opening out at one end into said second portion of the cavity, and at another end into a third portion of the cavity forming a lip of the outer platform of the blade;

wherein the first segment of the auxiliary grain duct extends from a wall of the first portion of the cavity in a direction that forms an angle lying in the range 54° to 62° with said wall;

wherein the second segment of the auxiliary grain duct extends from the second portion of the cavity in a direction forming an angle lying in the range 110° to 115° with said second portion; and wherein the second segment of the auxiliary grain duct extends from the third portion of the cavity in a direction forming an angle lying in the range 110° to 115° with said third portion.

2. A mold according to claim 1, wherein the second segment of the auxiliary grain duct presents at least one portion having a circular section of diameter D, said at least one portion being spaced apart from the cavity by a distance L, the ratio R=L/D between the distance L and the diameter D lying in the range 16.4 to 18.9 along said at least one portion.

3. A mold according to claim 1, wherein the second segment of the auxiliary grain duct includes a feeder at each of its ends.

4. A mold according to claim 1, wherein the blade is a turbine blade for an aviation turbine engine.

5. An installation for fabricating a blade molded from a molten metal, the installation comprising:

a mold according to claim 1; and monocrystalline grain obtaining means connected to the mold.

6. An installation according to claim 5, wherein the monocrystalline grain obtaining means comprise a monocrystalline seed or a grain selector duct.

7. A method of fabricating a monocrystalline turbine engine blade, the method comprising:

filling a mold of an installation according to claim 5 with a molten metal; and directionally solidifying the metal present in the mold so as to obtain a molded blade.

* * * * *